US012379131B2

(12) United States Patent
Naber

(10) Patent No.: US 12,379,131 B2
(45) Date of Patent: Aug. 5, 2025

(54) PIPE BEND FOR AN EXHAUST AIR DUCT OF A FUME EXTRACTION HOOD

(71) Applicant: Naber Holding Gmbh & Co., Nordhorn (DE)

(72) Inventor: Hans-Joachim Naber, Nordhorn (DE)

(73) Assignee: Naber Holding GmbH & Co., Nordhorn (DE)

( * ) Notice: Subject to any disclaimer, the term of this patent is extended or adjusted under 35 U.S.C. 154(b) by 550 days.

(21) Appl. No.: 17/749,461

(22) Filed: May 20, 2022

(65) Prior Publication Data

US 2022/0373219 A1 Nov. 24, 2022

(30) Foreign Application Priority Data

May 21, 2021 (DE) ..... 10 2021 113 234.7

(51) Int. Cl.
*F24F 13/08* (2006.01)

(52) U.S. Cl.
CPC ..... *F24F 13/081* (2013.01)

(58) Field of Classification Search
CPC ..... F24F 13/81
USPC ..... 454/49
See application file for complete search history.

(56) References Cited

U.S. PATENT DOCUMENTS

| | | | | |
|---|---|---|---|---|
| 4,919,170 | A * | 4/1990 | Kallinich | F23J 11/00 428/410 |
| 5,531,484 | A * | 7/1996 | Kawano | F16L 43/00 285/179.2 |
| 6,290,266 | B1 * | 9/2001 | Kawano | F16L 43/001 285/125.1 |
| 8,251,406 | B2 * | 8/2012 | Kawano | F15D 1/04 285/179 |
| 2003/0059291 | A1 | 3/2003 | Koshoffer et al. | |
| 2019/0316805 | A1 * | 10/2019 | Bruckbauer | F24F 13/02 |

FOREIGN PATENT DOCUMENTS

| | | | |
|---|---|---|---|
| AT | 008708 | U1 | 11/2006 |
| DE | 588113 | C | 11/1933 |
| DE | 971995 | C | 5/1959 |
| DE | 102007023119 | A1 | 11/2008 |
| EP | 1923576 | B1 | 3/2010 |
| JP | 2002266815 | A | 9/2002 |

* cited by examiner

*Primary Examiner* — Avinash A Savani
*Assistant Examiner* — Dana K Tighe
(74) *Attorney, Agent, or Firm* — Harness, Dickey & Pierce, P.L.C.

(57) ABSTRACT

A pipe bend for an exhaust air duct of a fume extraction hood, the pipe bend having at least one multi-part and curved air guide element which extends in the interior of the pipe bend, characterized in that a first and a second part element of the air guide element have a spacing (d) from one another in a radial direction of their curvature.

13 Claims, 2 Drawing Sheets

PIPE BEND FOR AN EXHAUST AIR DUCT OF A FUME EXTRACTION HOOD

CROSS-REFERENCE TO RELATED APPLICATIONS

This application claims the benefit and priority of German Patent Application No. 10 2021 113 234.7 filed May 21, 2021, the disclosure of which is hereby incorporated by reference herein in its entirety.

BACKGROUND OF THE INVENTION

Technical Field

The invention relates to a pipe bend for an exhaust air duct of a fume extraction hood, wherein the pipe bend comprises at least one multi-part and curved air guide element extending inside the pipe bend. Such a pipe bend is known from JP 2002-266815 A. A similar pipe bend with one-piece air guide elements is shown in EP 1 923 576 B1.

In the case of generic pipe bends for exhaust air ducts of fume extraction hoods and the like, it is basically desirable to keep the pressure loss in the duct as low as possible. It is known that the pressure loss to be expected is particularly high in the area of changes in direction of the duct, i.e. in particular in the area of the pipe bends, since due to the deflection of the air flow in the pipe bend, an at least partially non-laminar air flow occurs due to air detachments and associated turbulences in the pipe bend. The air detachments and turbulences lead not only to a pressure loss but also to noise generation, which is fundamentally undesirable and should be reduced to as low a level as possible. A first approach to counteract these problems is the use of air guide elements, although there is still a desire to further improve the achievable effects in terms of noise development and pressure loss reduction.

SUMMARY OF THE INVENTION

It is therefore an aspect of the invention to further develop a pipe bend of the type described above in such a way that it causes as little noise as possible and has a low as possible pressure loss for fluids flowing through it, in particular air and vapors.

Accordingly, in a pipe bend of the type described at the beginning, it is provided that a first and a second partial element of the air guide element are spaced apart in a radial direction of their curvature.

The air guide elements are preferably divided in the longitudinal direction between the opposite connection cross sections of the pipe bend. The curved air guide elements can be made of two parts. Alternatively, however, they can also be made in three parts or from even more parts. In the two-part design, the air guide elements are preferably divided halfway along their length in the direction of extension between the opposite connection cross sections of the pipe bend, for example at a vertex of the air guide element.

In one embodiment, the partial elements can overlap with each other in an overlap region of ends of the partial elements that face each other. In this case, it can be provided that the two part elements are spaced apart in front of each other in the overlap area just by the distance. In the overlap area, they can preferably extend parallel to each other.

In an alternative embodiment, the part elements can be aligned with their end faces facing each other. Preferably, they do not have to be exactly opposite each other. Rather, it can merely be provided that the end faces of the part elements are aligned in the radial direction of their curvature.

When the pipe bend has a plurality of curved air guide members, it may be provided that a first curved air guide member has overlapping part members of the type described above in an overlapping region, while a second curved air guide member has part members facing each other with their end faces aligned in the radial direction of curvature. For example, the curved air guide member with the overlapping partial members may be an outer curved air guide member, while the curved air guide member with the end faces aligned is an inner curved air guide member which is disposed closer to an inner radius of the pipe bend compared to the outer curved air guide member, thus having a smaller radius of curvature than the outer air guide member.

The at least one air guide element can reach with the first partial element up to a first of two opposite connection cross sections of the pipe bend. In an analogous manner, the at least one air guide element can reach with the second partial element up to a second of two opposite connection cross sections of the pipe bend.

At least one of the two partial elements of the curved air guide element can have a varying radius of curvature along its direction of extension towards the other partial element. Preferably, it may have a radius of curvature that increases monotonically at least in sections or decreases monotonically at least in sections. It may be provided that the two partial elements have the same radius of curvature at their ends facing away from each other. In particular, it can be provided that the two partial elements are aligned at their ends facing away from each other perpendicular to a respective connection cross section of the pipe bend.

The radius of curvature of a first of the two partial elements in the direction of flow through the pipe bend can increase in the direction of flow, and furthermore the radius of curvature of a second of the two partial elements in the direction of flow through the pipe bend can decrease in the direction of flow. In this way, for example, it can be achieved that the two partial elements of the air guide element, although they are perpendicular to their respective connection cross-section with one of their two ends in each case, have a distance from each other in the radial direction of their curvature in the region of the opposite ends at which they are maximally approached to each other.

It may be provided that the two radii of curvature of the first and second sub-elements change identically in amount or percentage to provide the spacing between the sub-elements according to the invention.

If the air guide element is designed in two parts, it can be provided in particular that the first and the second part element have the distance to each other at a vertex of the air guide element.

The pipe bend can have at least or exactly two air guide elements, of which a first is an air guide element with overlapping partial elements, and of which a second air guide element is one in which the partial elements are aligned with their end faces in the radial direction of their curvature. Thereby, the first air guide element can have a larger mean radius than the second air guide element. Thus, the first air guide element may be further away from an inner radius of the pipe bend in comparison to the second air guide element, which is located closer to the inner radius of the pipe bend.

The first air guide member may bisect a connecting cross section of the pipe bend into a half facing a pipe bend inner wall of the pipe bend and a half facing a pipe bend outer wall of the pipe bend. Thereby, the second air guide member may bisect the half facing the inner pipe bend wall of the pipe bend into a half facing the first air guide member and a half facing the inner pipe bend wall of the pipe bend.

In particular, the pipe bend can be designed as a flat duct bend or as a transition bend from a rectangular flat duct connection to a round duct connection, or vice versa.

It has been found that the spacing of the partial elements in the radial direction of the curvature of the air guide element leads to a reduction in flow separation and thus to a suppression of the formation of turbulence in the pipe bend, which ultimately reduces the pressure loss and noise development of the pipe bend compared to pipe bends known from the prior art.

BRIEF DESCRIPTION OF THE DRAWINGS

Further details of the invention are explained with reference to the figures below. Thereby.

DETAILED DESCRIPTION OF THE PREFERRED EMBODIMENTS

Figure 1:
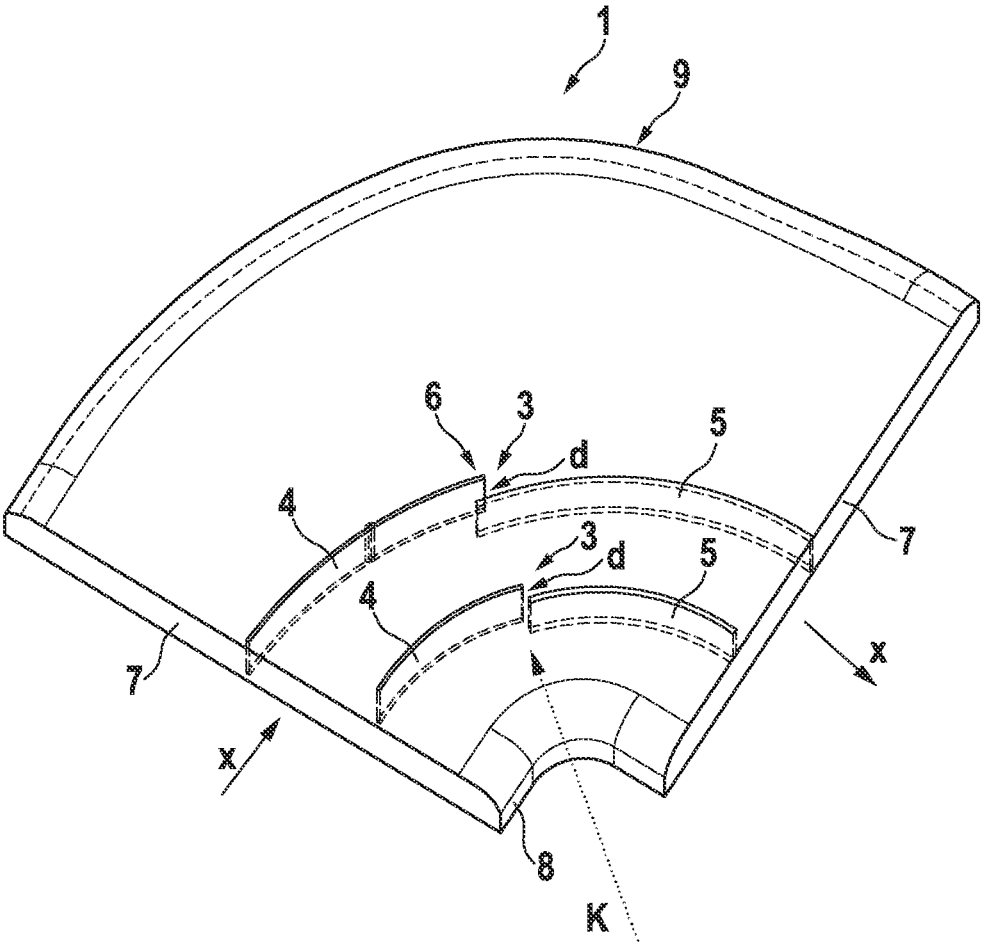
FIG. 1 shows in perspective and semi-transparent view a pipe bend in the form of a flat duct according to one embodiment of the invention.
Figure 2:
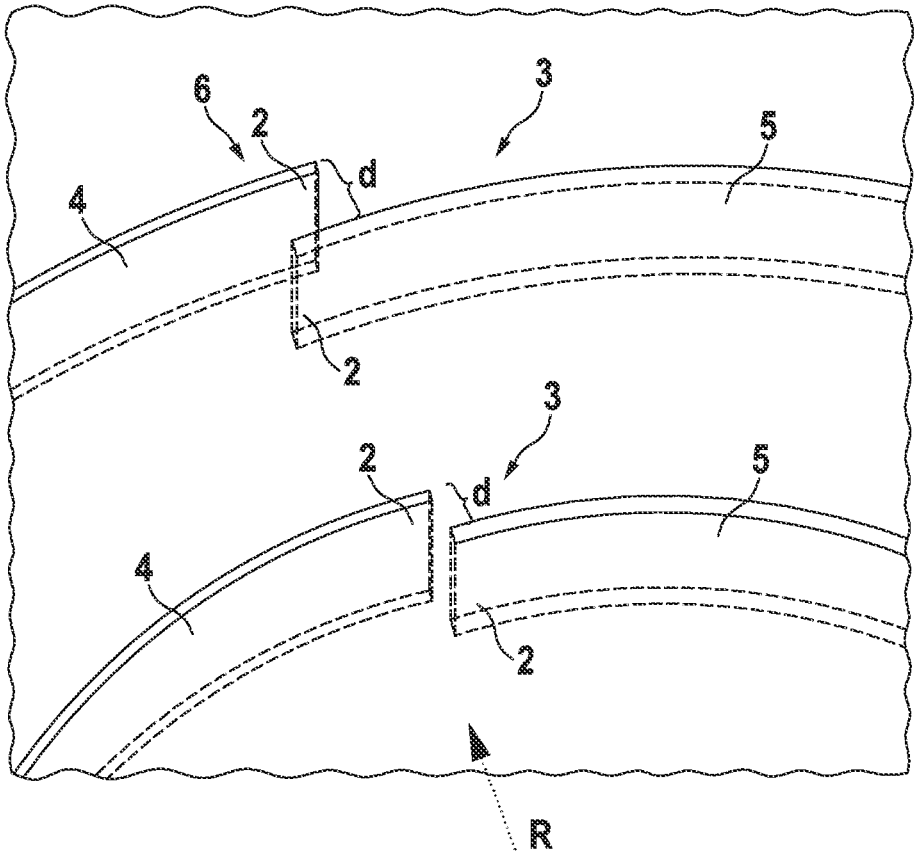
FIG. 2 is a detailed view of the pipe bend according to FIG. 1 in the adjoining area of opposite partial elements.

The embodiment of a pipe bend 1 according to the invention shown in FIGS. 1 and 2 is designed as a flat duct and accordingly has a substantially rectangular cross-section with rounded corners. Consequently, the pipe bend 1 is particularly suitable for exhaust air ducts which have a corresponding rectangular cross-section, as is known in principle from the prior art, in order to provide, in particular in a space-saving manner, for example in the base of a kitchen cabinet or in the ceiling area of a room, an exhaust air duct for connecting, for example, an fume extraction hood to a wall box for the discharge of vapors.

The pipe bend 1 according to the invention has two two-part and curved air guide elements 3, which each have a first and a second part element 4, 5. According to the invention, the first and the second partial element 4, 5 of the air guide element 3 have a distance d from each other in the radial direction R of the curvature of the air guide element 3.

As can be seen, the partial elements 4, 5 of the air guide element 3 facing the pipe bend outer wall 9 overlap in an overlap area 6 of the facing ends 2 of the partial elements 4, 5. Deviating from this, the two partial elements 4, 5 of the air guide element facing the pipe bend inner wall 8 of the pipe bend 1 do not have an overlap area. It is true that the two opposite ends 2 of the partial elements 4, 5 have the distance d from one another in the radial direction R according to the invention. On the other hand, however, they stand straight in the radial direction R with their opposite end faces in alignment with the radial direction R.

The distance d between the two sub-elements 4, 5 can be provided precisely by the fact that, in the flow direction x of the air through the pipe bend 1, the two first sub-elements 4 have a continuous increase in their radius of curvature, while the radius of curvature of the second sub-elements 5 arranged in the flow direction x through the pipe bend decreases in the flow direction x.

The features of the invention disclosed in the foregoing description, in the drawings as well as in the claims may be essential to the realization of the invention both individually and in any combination.

The invention claimed is:

1. A pipe bend for an exhaust air duct of a fume extraction hood, comprising at least one curved air guide element which extends in an interior of the pipe bend, the at least one guide element having first and second partial parts spaced from each other, wherein the first and the second partial parts of the air guide element are at a distance (d) from one another in a radial direction of their curvature, and wherein the first and second partial parts have end faces that are aligned with each other in the radial direction of their curvature.

2. The pipe bend according to claim 1, wherein the end faces of the partial parts overlap with each other.

3. The pipe bend according to claim 2, in which the end faces of the first and second partial parts are spaced apart from one another in the overlap area by the distance (d).

4. The pipe bend according to claim 1, wherein the at least one air guide element with the first partial part extends up to a first of two opposite connection cross-sections of the pipe bend, and wherein the at least one air guide element with the second partial part extends up to the second of two opposite connection cross-sections of the pipe bend.

5. The pipe bend according to claim 1, in which at least one of the two partial parts has a varying radius of curvature along its direction of extension towards the other partial part, wherein the radius of curvature which increases monotonically at least in sections or decreases monotonically at least in sections.

6. The pipe bend according to claim 5, in which the two partial elements have the same radius of curvature at their ends facing away from each other.

7. The pipe bend according to claim 5, wherein the radius of curvature of a first one of the two partial elements in the flow direction through the pipe bend increases in the flow direction and the radius of curvature of a second one of the two partial elements in the flow direction through the pipe bend decreases in the flow direction.

8. The pipe bend according to claim 7, in which the two radii of curvature change identically in amount or percentage.

9. The pipe bend according to claim 1, wherein the air guide element is in two parts, the first and second partial elements having the distance at a vertex of the air guide element.

10. The pipe bend according to claim 1, wherein the at least one guide element comprises a first and a second air guide element.

11. The pipe bend according to claim 10, wherein the first air guide element has a larger mean radius than the second air guide element.

12. The pipe bend according to claim 10, wherein the first air guide element bisects a connecting cross-section of the pipe bend into a half facing a pipe bend inner wall of the pipe bend and a half facing a pipe bend outer wall of the pipe bend, wherein the second air guide element bisects the half facing the pipe bend inner wall of the pipe bend into a half facing the first air guide element and into a half facing the pipe bend inner wall of the pipe bend.

13. The pipe bend according to claim 1, which is formed as a flat duct bend or as a transition bend from a rectangular flat duct connection to a round duct connection, or vice versa.

* * * * *